US011492890B2

(12) United States Patent
Madasu et al.

(10) Patent No.: US 11,492,890 B2
(45) Date of Patent: Nov. 8, 2022

(54) ITERATIVE REAL-TIME STEERING OF A DRILL BIT

(71) Applicant: LANDMARK GRAPHICS CORPORATION, Houston, TX (US)

(72) Inventors: Srinath Madasu, Houston, TX (US); Keshava Prasad Rangarajan, Sugar Land, TX (US); Robello Samuel, Cypress, TX (US); Nishant Raizada, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 378 days.

(21) Appl. No.: 16/631,542

(22) PCT Filed: Aug. 21, 2017

(86) PCT No.: PCT/US2017/047748
§ 371 (c)(1),
(2) Date: Jan. 16, 2020

(87) PCT Pub. No.: WO2019/040039
PCT Pub. Date: Feb. 28, 2019

(65) Prior Publication Data

US 2020/0173269 A1 Jun. 4, 2020

(51) Int. Cl.
*E21B 44/00* (2006.01)
*E21B 7/04* (2006.01)

(52) U.S. Cl.
CPC ..... *E21B 44/00* (2013.01); *E21B 7/04* (2013.01)

(58) Field of Classification Search
CPC ... E21B 44/00; E21B 7/04; E21B 7/06; E21B 41/0092; E21B 49/00; G06F 17/11
See application file for complete search history.

(56) References Cited

U.S. PATENT DOCUMENTS 8,214,188 B2 * 7/2012 Bailey ..... E21B 7/00 702/6
8,838,426 B2 * 9/2014 Aldred ..... E21B 41/0092 703/10

(Continued)

FOREIGN PATENT DOCUMENTS

CN 104246107 A * 12/2014 ..... E21B 44/00
CN 105518251 A * 4/2016 ..... E21B 41/0092

(Continued)

OTHER PUBLICATIONS

U.S. Patent Application Publication 2017/0058658, Mar. 2017, see the shortened version.*

(Continued)

*Primary Examiner* — Kandasamy Thangavelu
(74) *Attorney, Agent, or Firm* — Kilpatrick Townsend & Stockton LLP

(57) ABSTRACT

A system for real-time steering of a drill bit includes a drilling arrangement and a computing device in communication with the drilling arrangement. The system iteratively, or repeatedly, receives new data associated the wellbore. At each iteration, a model, for example an engineering model, is applied to the new data to produce an objective function defining the selected drilling parameter. The objective function is modified at each iteration to provide an updated value for the selected drilling parameter and an updated value for at least one controllable parameter. In one example, the function is modified using Bayesian optimization The system iteratively steers the drill bit to obtain the updated value for the selected drilling parameter by applying the updated value for at least one controllable parameter over the period of time that the wellbore is being formed.

16 Claims, 7 Drawing Sheets

(56) References Cited

U.S. PATENT DOCUMENTS

| | | | | |
|---|---|---|---|---|
| 2003/0168257 | A1 | 9/2003 | Aldred et al. | |
| 2004/0256152 | A1 | 12/2004 | Dashevskiy et al. | |
| 2009/0250264 | A1 | 10/2009 | Dupriest | |
| 2011/0174541 | A1* | 7/2011 | Strachan | E21B 44/00 702/9 |
| 2011/0270591 | A1* | 11/2011 | Couet | G06F 17/11 703/2 |
| 2013/0105221 | A1 | 5/2013 | Wassell | |
| 2013/0146358 | A1 | 6/2013 | Disantis | |
| 2014/0277752 | A1* | 9/2014 | Chang | E21B 44/00 700/275 |
| 2017/0058658 | A1* | 3/2017 | Spencer | E21B 7/04 |

FOREIGN PATENT DOCUMENTS

| | | | | |
|---|---|---|---|---|
| WO | WO 2010/039317 A * | 4/2010 | | E21B 47/00 |
| WO | WO 2010039342 A1 * | 4/2010 | | G01B 3/44 |
| WO | 2014091462 | 6/2014 | | |
| WO | WO 2016/040139 A1 * | 3/2016 | | E21B 49/00 |
| WO | WO 2016/160005 A1 * | 10/2016 | | E21B 44/00 |

OTHER PUBLICATIONS

U.S. Patent Application Publication 2014/0277752, Sep. 2014, see the shortened version.*

U.S. Patent Application Publication 2011/0270591 A, Nov. 2011, see the shortened version.*

Kshitij Mohan et al., "Comprehensive Hydromechanical Specific Energy Calculation for Drilling Efficiency", ASME Jan. 2015.*

Brochu, "Interactive Bayesian Optimization: Learning User Preferences for Graphics and Animation", A Thesis Submitted in Partial Fulfillment of the Requirements for the Degree of Doctor of Philosophy in the Faculty of Graduate Studies, Dec. 2010, 135 pages.

Chen, et al., "Real-time Optimization of Drilling Parameters Based on Mechanical Specific Energy for Rotating Drilling with Positive", Journal of Natural Gas Science and Engineering, vol. 35, Sep. 2016, pp. 686-694.

Ettehadi Osgouei, "Rate of Penetration Estimation Model for Directional and Horizontal Wells", A Thesis Submitted to the Graduate School of Natural and Applied Sciences of Middle East Technical University, Sep. 2007, 98 pages.

Hamrick, "Optimization of Operating Parameters for Minimum Mechanical Specific Energy in Drilling", DAI-B 72/12, Dissertation Abstracts International, 2011, 147 pages.

Mohan, et al., "Tracking Drilling Efficiency Using Hydro-Mechanical Specific Energy", SPE/IADC Drilling Conference and Exhibition, Mar. 17-19, Amsterdam, The Netherlands, SPE-119421-MS, Mar. 17-19, 2009, 12 pages.

Payette, et al., "A Real-Time Well-Site Based Surveillance and Optimization Platform for Drilling: Technology, Basic Workflows and Field Results", Conference: Conference: SPE/IADC Drilling Conference and Exhibition, SPE-184615-MS, Mar. 14-16, 2017, 19 pages.

PCT/US2017/047748, "International Search Report and Written Opinion", dated May 17, 2018, 6 pages.

CA. Application No. CA3,069,724 , Office Action, dated Sep. 24, 2021, 3 pages.

CA. Application No. CA3,069,724 , Office Action, dated Apr. 16, 2021, 5 pages.

GB Application No. GB2000830.6 , "First Examination Report", dated Oct. 1, 2021, 4 pages.

* cited by examiner

ITERATIVE REAL-TIME STEERING OF A DRILL BIT

TECHNICAL FIELD

The present disclosure relates generally to devices for use in well systems. More specifically, but not by way of limitation, this disclosure relates to real-time automated closed-loop control of a drill bit during the drilling of a wellbore.

BACKGROUND

A well (e.g., an oil or gas well) includes a wellbore drilled through a subterranean formation. The conditions inside the subterranean formation where the drill bit is passing when the wellbore is being drilled continuously change. For example, the formation through which a wellbore is drilled exerts a variable force on the drill bit. This variable force can be due to the rotary motion of the drill bit, the weight applied to the drill bit, and the friction characteristics of each strata of the formation. A drill bit may pass through many different materials, rock, sand, shale, clay, etc., in the course of forming the wellbore and adjustments to various drilling parameters are sometimes made during the drilling process by a drill operator to account for observed changes.

DETAILED DESCRIPTION

Figure 1:
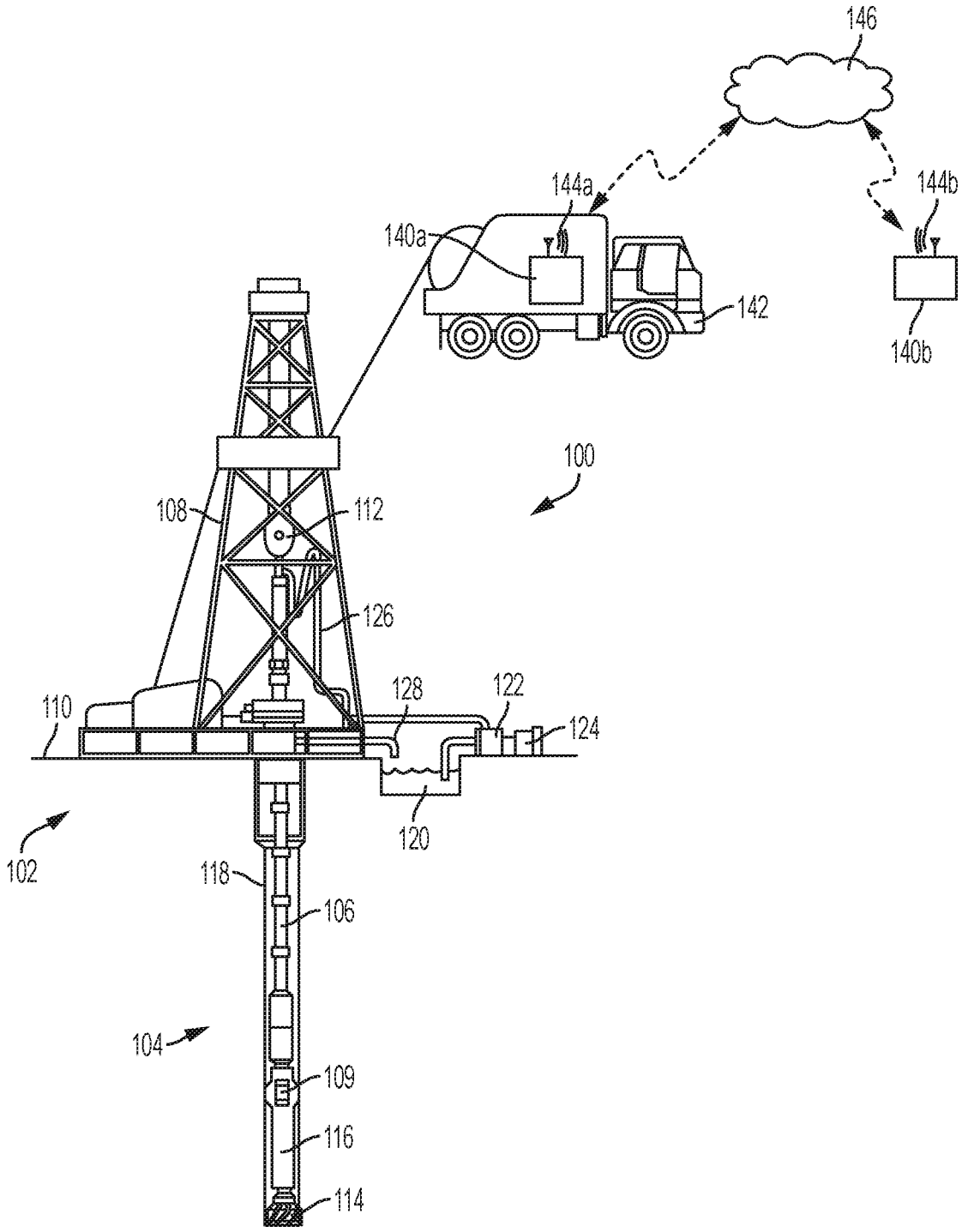
FIG. 1 is a cross-sectional view of an example of a well system that includes a system for steering a drill bit according to some aspects.

Certain aspects and features of the present disclosure relate to real-time, automated steering of a drill bit forming a wellbore to maintain a value for a selected drilling parameter despite variations in the characteristics of the various strata of a subterranean formation through which the drill bit passes. Other variations, such as those introduced by changing characteristics of the drill string or drilling arrangement as the length of the drill string increases, can also be taken into account.

Stochastic optimization based on Bayesian optimization can be used to maximize a selected drilling parameter, such as rate of penetration (ROP), and minimize a parameter such as hydraulic mechanical specific energy (HMSE) along the well path. The combination of these parameters may also be maximized and expressed as a parameter that is a ratio of the two, ROP/HMSE. Updated real-time data can include current values for controllable parameters such as weight-on-bit (WOB), drill bit rotations in revolutions per minute (RPM), and flow rate (Q). A closed-loop control system for steering a drill bit can be provided by mathematically coupling the non-linear discontinuous constraints and the real-time drilling data.

In some examples, a system for steering a drill bit iteratively, or repeatedly, receives new data associated with the wellbore being formed by a drill bit over a period of time. At each iteration over the period of time, an engineering model is built from the new data to produce an objective function defining the selected drilling parameter. The objective function can be modified at each iteration to provide an updated response value for the selected drilling parameter and an updated output value for at least one controllable parameter. One example of a modification technique that can be used is stochastic optimization. The system can iteratively steer the drill bit in real time to obtain the updated response value for the selected drilling parameter by applying the updated output value for the controllable parameter to the drill bit while the wellbore is being formed.

In one example, the model is an engineering model including at least one nonlinear constraint. The nonlinear constraints model one or more of whirl, torque and drag, and wellbore fluid pumping rate. Modifying of the objective function can include Bayesian optimization, or optimization using Bayesian sampling based upon a selected improvement and then calculating an actual improvement using a Gaussian model.

The selected drilling parameter can include ROP, HMSE, or the ratio ROP/HMSE. In one example, data collected can include current WOB, rotations-per-minute (RPM), or flow rate. Data collected can also include controllable parameters, such as a result of an iteration. Data on those parameters can be collected when a new iteration begins, forming a closed-loop control system.

In one example, the objective function is a loss function, which can also be referred to as a cost function. The loss function can be minimized or maximized depending on the selected drilling parameter. For example, if the selected drilling parameter is ROP, the value can be maximized. If the selected drilling parameter is HMSE, the value can be minimized.

Using some examples of the present disclosure can result in real-time, automated, closed-loop control of a drilling operation. Some examples of the present disclosure accurately and robustly predict a control value for steering the drill bit as drilling conditions change in order to optimize or nearly optimize a drilling parameter, while automatically taking constraints on the drilling equipment into account. Some examples of the present disclosure allow different drilling parameters to be selected by an operator for the job at hand.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 that may employ one or more principles of the present disclosure. A wellbore may be created by drilling into the earth 102 using the drilling system 100. The drilling system 100 may be configured to drive a bottom hole assembly (BHA) 104 positioned or otherwise arranged at the bottom of a drillstring 106 extended into the earth 102 from a derrick 108 arranged at the surface 110. The derrick 108 includes a kelly 112 used to lower and raise the drillstring 106. The BHA 104 may include a drill bit 114 operatively coupled to a tool string 116, which may be moved axially within a drilled wellbore 118 as attached to the drillstring 106. Tool string 116 may include one or more sensors 109 to determine conditions of the drill bit and wellbore, and return values for various parameters to the surface through cabling (not shown) or by wireless signal. The combination of any support structure (in this example, derrick 108), any motors, electrical connections, and support for the drillstring and tool string may be referred to herein as a drilling arrangement.

During operation, the drill bit 114 penetrates the earth 102 and thereby creates the wellbore 118. The BHA 104 provides control of the drill bit 114 as it advances into the earth 102. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drillstring 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drillstring 106, and in the process returns drill cuttings and debris to the surface. The cuttings and mud mixture are passed through a flow line 128 and are processed such that a cleaned mud is returned down hole through the stand pipe 126 once again.

Still referring to FIG. 1, the drilling arrangement and any sensors 109 (through the drilling arrangement or directly) are connected to a computing device 140*a*. In FIG. 1, the computing device 140*a* is illustrated as being deployed in a work vehicle 142, however, a computing device to receive data from sensors 109 and control drill bit 114 can be permanently installed with the drilling arrangement, be hand-held, or be remotely located. In some examples, the computing device 140*a* can process at least a portion of the data received and can transmit the processed or unprocessed data to another computing device 140*b* via a wired or wireless network 146. The other computing device 140*b* can be offsite, such as at a data-processing center. The other computing device 140*b* can receive the data, execute computer program instructions to determine parameters to apply to the drill bit, and communicate those parameters to computing device 140*a*.

The computing devices 140*a-b* can be positioned belowground, aboveground, onsite, in a vehicle, offsite, etc. The computing devices 140*a-b* can include a processor interfaced with other hardware via a bus. A memory, which can include any suitable tangible (and non-transitory) computer-readable medium, such as RAM, ROM, EEPROM, or the like, can embody program components that configure operation of the computing devices 140*a-b*. In some aspects, the computing devices 140*a-b* can include input/output interface components (e.g., a display, printer, keyboard, touch-sensitive surface, and mouse) and additional storage.

The computing devices 140*a-b* can include communication devices 144*a-b*. The communication devices 144*a-b* can represent one or more of any components that facilitate a network connection. In the example shown in FIG. 1, the communication devices 144*a-b* are wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication devices 144*a-b* can use acoustic waves, surface waves, vibrations, optical waves, or induction (e.g., magnetic induction) for engaging in wireless communications. In other examples, the communication devices 144*a-b* can be wired and can include interfaces such as Ethernet, USB, IEEE 1394, or a fiber optic interface. The computing devices 140*a-b* can receive wired or wireless communications from one another and perform one or more tasks based on the communications.

Figure 2:
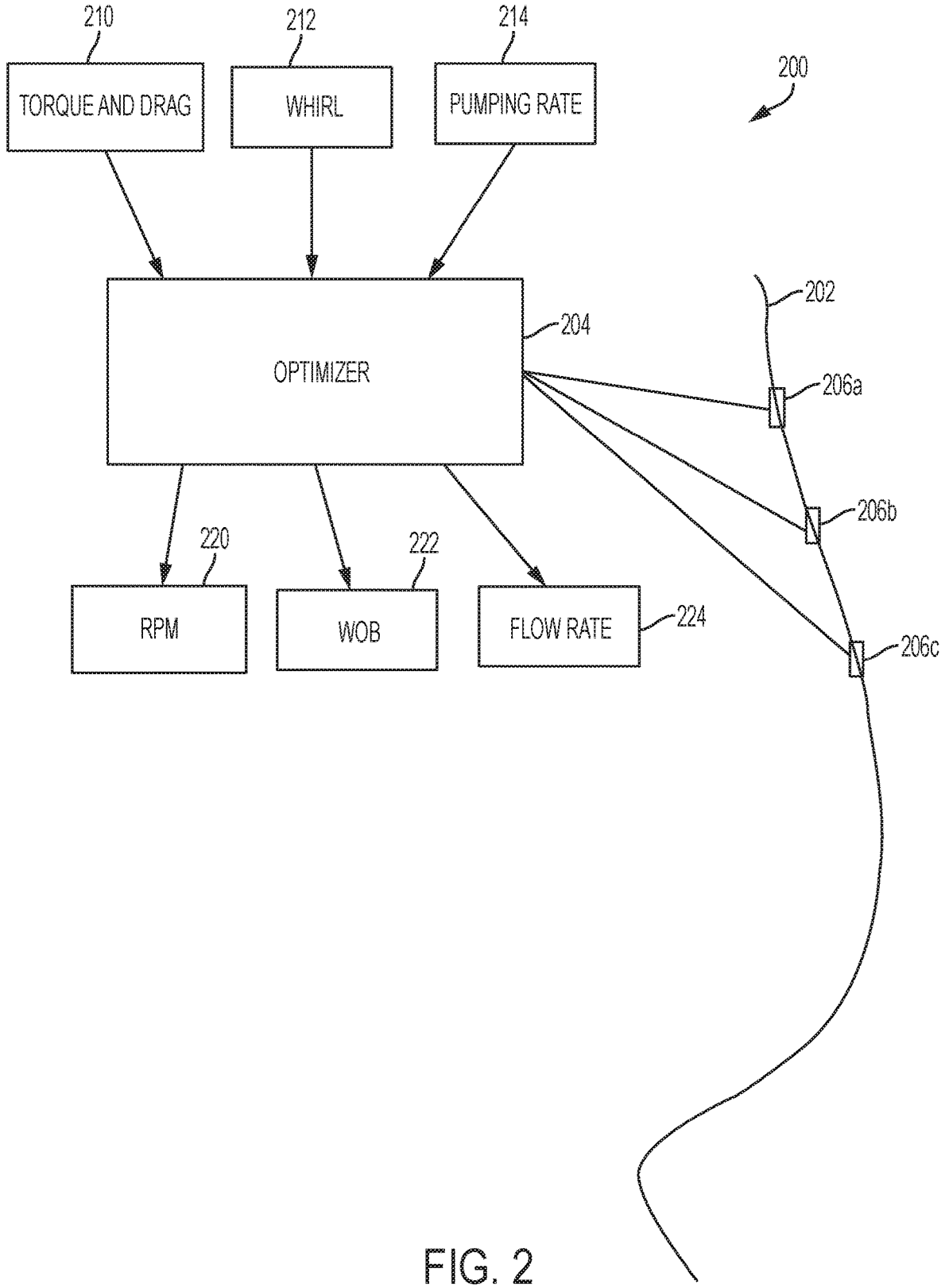
FIG. 2 is a schematic diagram of a system for steering a drill bit according to some aspects.

FIG. 2 is a schematic diagram of system 200 for steering a drill bit along projected path 202 of a wellbore being formed by the drill bit. Computer program instructions include an optimizer 204 comprising an objective function that can be executed by a processor to iteratively control a drill bit connected to a drilling arrangement by applying a Bayesian model to data received at each iteration, 206*a*, 206*b*, and 206*c*. Typically, many more iterations can occur than are shown in FIG. 2. Optimizer 204 can be executed subject to nonlinear constraints. These nonlinear constraints model one or more of torque and drag 210, whirl 212, and wellbore fluid pumping rate 214. Whirl can be a disruptive resonance in the drillstring at certain RPMs. Ranges around these RPM values can be avoided. The RPM values can change with the length and depth of the drillstring. Pumping rate can be the maximum rate at which debris-filled fluid can be removed from the wellbore. The rate of penetration of the drill bit may not exceed that which creates the maximum amount of debris that can be removed from the wellbore by fluid pumping in a specified amount of time. Torque and drag can be forces exerted on the drill bit by friction with the subterranean formation in which the wellbore is being formed. Optimizer 204 can produce values for controllable parameters that can be applied to the drill bit. Such controllable parameters can include drill bit speed (here in units of RPM) 220, weight-on-bit (WOB) 222, and flow rate 224. Flow rate can be the rate at which fluid (e.g., mud) is pumped into the wellbore.

Figure 3:
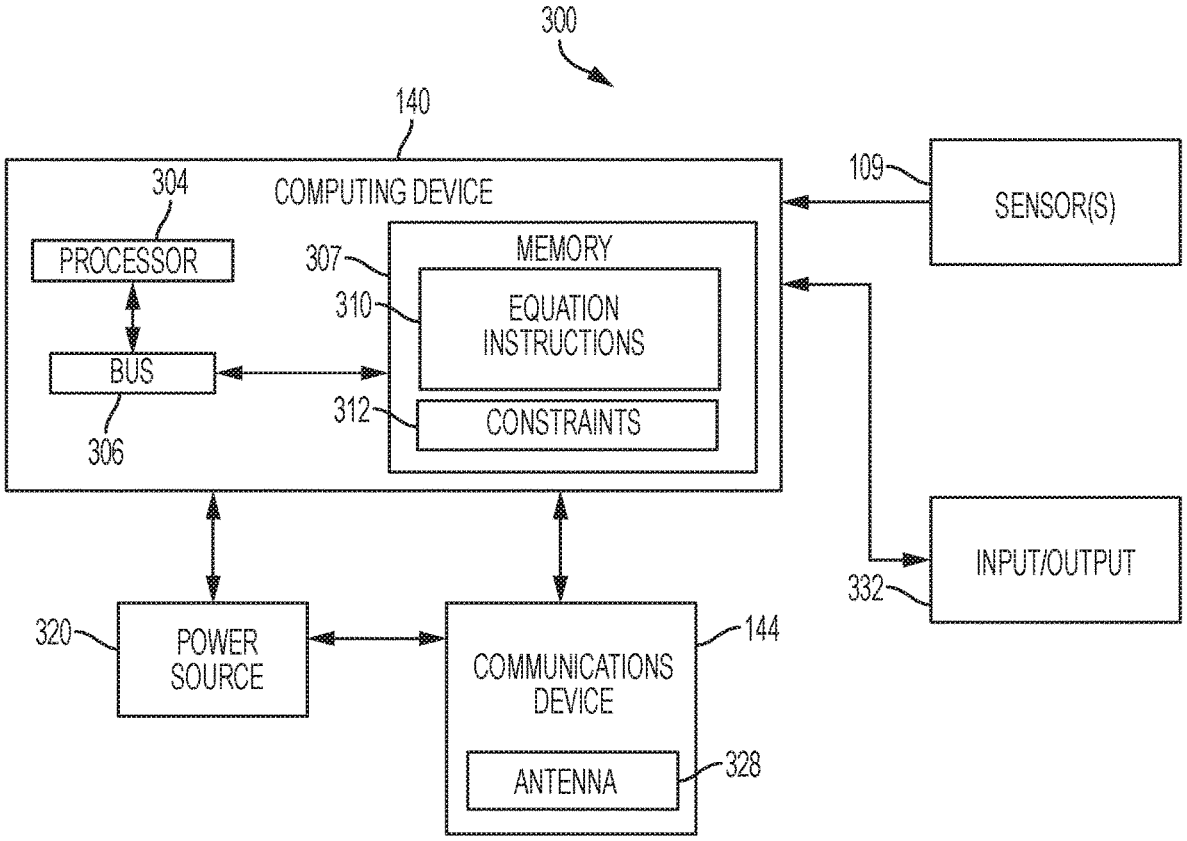
FIG. 3 is a block diagram of a computing system for steering the drill bit according to some aspects.

FIG. 3 is a block diagram of an example of a system 300 for steering a drill bit to obtain a specified drilling parameter over time according to some aspects. In some examples, the components shown in FIG. 3 (e.g., the computing device 140, power source 320, and communications device 144) can be integrated into a single structure. For example, the components can be within a single housing. In other examples, the components shown in FIG. 3 can be distributed (e.g., in separate housings) and in electrical communication with each other.

The system 300 includes a computing device 140. The computing device 140 can include a processor 304, a memory 307, and a bus 306. The processor 304 can execute one or more operations for obtaining data associated with the wellbore and steering the drill bit to maintain the selected drilling parameter. The processor 304 can execute instructions stored in the memory 307 to perform the operations. The processor 304 can include one processing device or multiple processing devices. Non-limiting examples of the processor 304 include a Field-Programmable Gate Array ("FPGA"), an application-specific integrated circuit ("ASIC"), a microprocessor, etc.

The processor 304 can be communicatively coupled to the memory 307 via the bus 306. The non-volatile memory 307 may include any type of memory device that retains stored information when powered off. Non-limiting examples of the memory 307 include electrically erasable and programmable read-only memory ("EEPROM"), flash memory, or any other type of non-volatile memory. In some examples, at least part of the memory 307 can include a medium from which the processor 304 can read instructions. A computer-readable medium can include electronic, optical, magnetic, or other storage devices capable of providing the processor 304 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

In some examples, the memory 307 can include computer program instructions for executing one or more equations, referred to in FIG. 3 as equation instructions 310. The equation instructions 310 can be usable for applying an engineering model to data associated with the wellbore and steering the drill bit to obtain a value for a selected drilling parameter. Examples of the equations can include any of the equations described with respect to FIG. 4. In some examples, the memory 307 can include stored values for nonlinear constraints 312. The nonlinear constraints 312 can include one or more values for torque and drag, whirl, and wellbore fluid pumping rate as previously discussed.

The system 300 can include a power source 320. The power source 320 can be in electrical communication with the computing device 140 and the communications device 144. In some examples, the power source 320 can include a battery or an electrical cable (e.g., a wireline). In some examples, the power source 320 can include an AC signal generator. The computing device 140 can operate the power source 320 to apply a transmission signal to the antenna 328. For example, the computing device 140 can cause the power source 320 to apply a voltage with a frequency within a specific frequency range to the antenna 328. This can cause the antenna 328 to generate a wireless transmission. In other examples, the computing device 140, rather than the power source 320, can apply the transmission signal to the antenna 328 for generating the wireless transmission.

The system 300 can also include the communications device 144. The communications device 144 can include or can be coupled to the antenna 328. In some examples, part of the communications device 144 can be implemented in software. For example, the communications device 144 can include instructions stored in memory 307. The communications device 144 can receive signals from remote devices and transmit data to remote devices (e.g., the computing device 140*b* of FIG. 1). For example, the communications device 144 can transmit wireless communications that are modulated by data via the antenna 328. In some examples, the communications device 144 can receive signals (e.g., associated with data to be transmitted) from the processor 304 and amplify, filter, modulate, frequency shift, and otherwise manipulate the signals. In some examples, the communications device 144 can transmit the manipulated signals to the antenna 328. The antenna 328 can receive the manipulated signals and responsively generate wireless communications that carry the data.

The system 300 can receive input from sensor(s) 109, shown in FIG. 1. System 300 in this example also includes input/output interface 332. Input/output interface 332 can connect to a keyboard, pointing device, display, and other computer input/output devices. An operator may provide input using the input/output interface 332. Such input may include a selected drilling parameter for the particular wellbore being formed on a particular job. However, the use of the phrase "selected drilling parameter" does not imply that user selection is necessarily possible in any particular implementation as this phrase could mean that a particular drilling parameter was selected as part of the design of the system.

Figure 4:
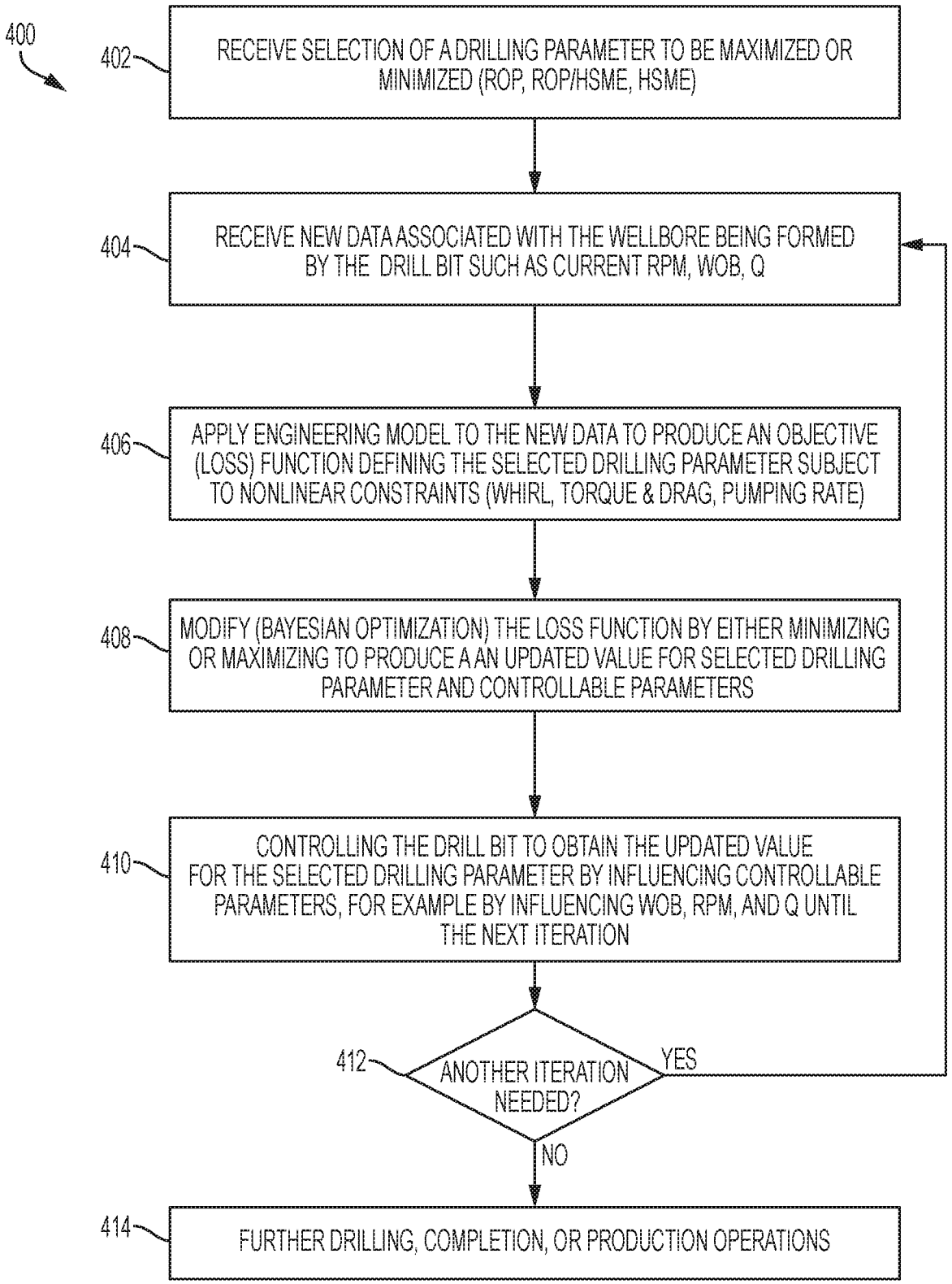
FIG. 4 is an example of a flowchart of a process for steering a drill bit according to some aspects.

FIG. 4 is an example of a flowchart of a process for automated real-time steering of a drill bit during formation of a wellbore. Some examples can include more, fewer, or different blocks than those shown in FIG. 4. The blocks shown in FIG. 4 can be implemented using, for example, one or more of the computing devices 140*a-b* shown in FIG. 1 and FIG. 3.

During the drilling process, drilling fluids such as the mud shown in FIG. 1 are circulated to clean the cuttings while the drill bit is penetrating through the formation. Also, the drill string may have resonances (whirl) to be avoided. The response surface for variables such as ROP and HMSE is discontinuous; hence, using a stochastic-based approach can provide for fast response times that enable real-time steering. Leading up to an iteration, the current value of controllable parameters such as WOB, RPM and Q can be known from the sensors in the wellbore, the state of surface equipment, or both. The selected drilling parameter is treated as a response variable. Thus, a value for the selected drilling parameter resulting from an iteration may be referred to herein as a response value. The selected drilling parameters can be chosen in order for drilling to be accomplished relatively quickly while minimizing potential problems that might be caused by issues such as too much friction, whirl, or attempting to drill too quickly.

Process 400 of FIG. 4 begins at block 402 with the receipt of a selection of a drilling parameter to be maximized or minimized. As examples, ROP or ROP/HMSE can be maximized and HMSE can be minimized. At block 404, data associated with a wellbore is received. In this example, the data includes the current values for controllable parameters RPM, WOB, and Q. At block 406, an engineering model is applied to the data to produce an objective function defining the selected drilling parameter. In this example the objective function is a loss function, sometimes also referred to as a cost function. As previously discussed, constraints in this example model, whirl, torque, drag, and wellbore fluid pumping rate. During the drilling process, drilling fluids are circulated to clean the cuttings while the drill bit is forming the wellbore. This debris is pumped out of the wellbore and the removed fluid is cleaned and recirculated. The pumping rate is the rate at which the wellbore is or can be pumped out, as opposed to the flow rate, which is how fast the fluid (i.e., drilling mud) is pumped in. The pumping rate is treated herein as a nonlinear constraint while the flow rate is treated as a controllable parameter.

For ROP, the engineering model can be expressed as:

$$\mathrm{ROP}=K(\mathrm{WOB})^{\alpha 1}(\mathrm{RPM})^{\alpha 2}, \tag{1}$$

where K is the drilling constant, $\alpha^1$, $\alpha^2$ are correlation constants obtained from data. In practice, the first of the above correlation constants represents weight-on-bit compared to ROP and the second correlation constant represents how sensitive ROP is to RPM and these constants are determined by regression fit.

The loss function resulting from the engineering model above can be expressed as:

$$g(\mathrm{WOB}, \mathrm{RPM})=\mathrm{ROP} \tag{2}$$

The loss function above is maximized by optimization at block 408 of FIG. 4, essentially repeatedly modifying the inputs to produce an updated, maximum value for the selected drilling parameter and values for the controllable parameters subject to the nonlinear constraints. A value for a controllable parameter may be referred to herein as a control value. This process is accomplished, as an example, by Bayesian sampling based on an expected improvement while calculating an actual improvement using a Gaussian model. A graphical explanation of the output of process described above is provided with respect to FIGS. 5 and 6, discussed later.

Still referring to FIG. 4, at block 410 the drill bit is the controlled to obtain the maximized (or minimized) selected drilling parameter. For example, following the above example for maximizing ROP, WOB, RPM, Q, or a combination of two or all of these are adjusted after each iteration to maximize ROP. If the wellbore is still being formed at block 412 and another iteration is needed, processing returns to block 404 and the process described above is repeated. Otherwise, the process continues to further drilling, completion, or production operations at block 414.

An engineering model for HMSE can be expressed as:

$$HMSE = \left(\frac{WOB - \eta F}{A_b}\right) + \left(\frac{120 * RPM * T + \eta * P * Q}{A_b * ROP}\right), \quad (3)$$

where η is a friction coefficient, F is the impact force, T is the torque obtained from data, P is the pressure drop across the bit, and $A_b$ is the bit area. This model can be used to define a loss function to be maximized for ROP/HMSE:

$$g(\text{WOB, RPM})=\text{ROP/HMSE}, \quad (4)$$

or a loss function to be minimized for HMSE alone:

$$g(\text{WOB, RPM})=\text{HMSE}. \quad (5)$$

The process for maximizing ROP/HMSE and minimizing HMSE is the same one shown in FIG. 4, discussed above, only using different equations for the Bayesian optimizaton of the objective function.

Figure 5:
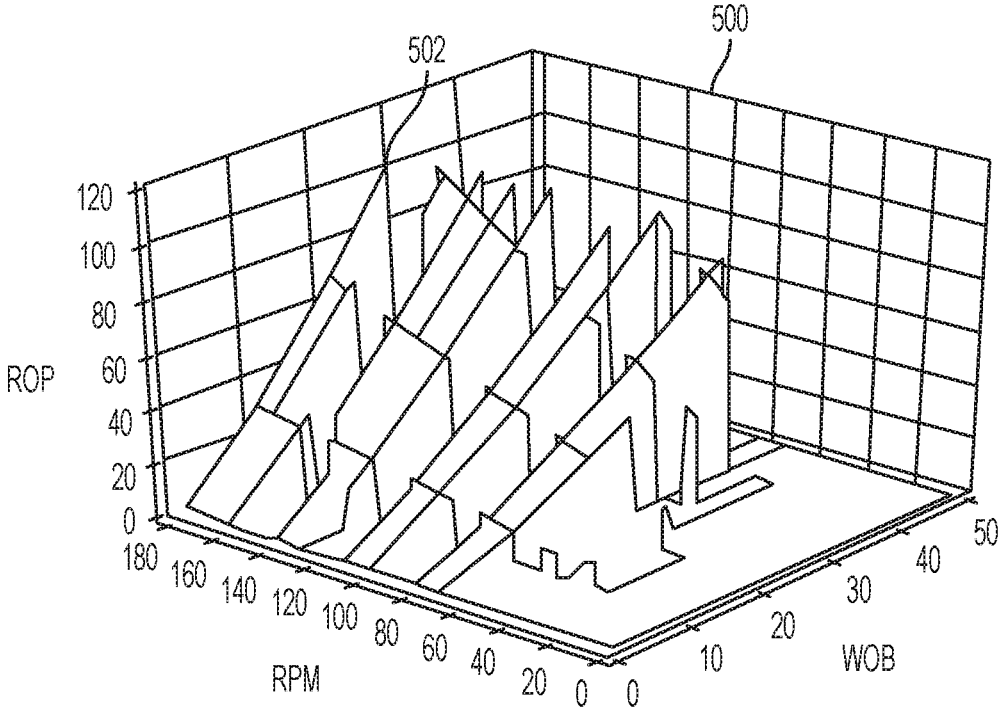
FIG. 5 is a graph of a three-dimensional response surface for a selected drilling parameter used in a system for steering a drill bit according to some aspects.

FIG. 5 is an example three-dimensional graph 500 of a response surface generated by the loss function for ROP. The vertical axis of graph 500 is marked with ROP in units of feet-per-hour. The horizontal axis for WOB is in units of pounds per square inch (PSI). The maximum of the surface shown in FIG. 5 is point 502.

Figure 6:
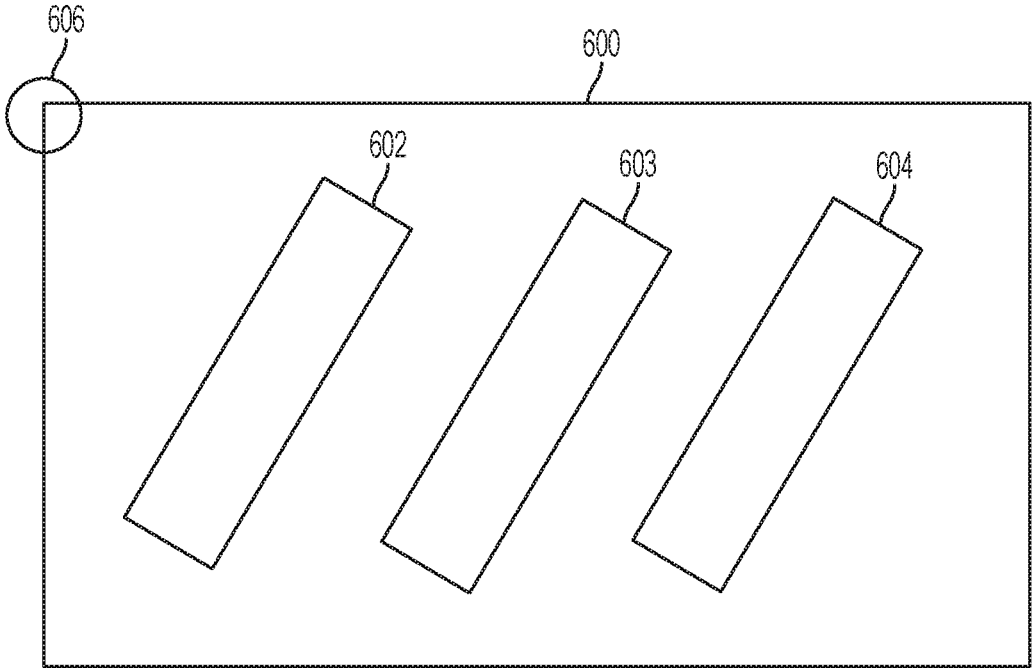
FIG. 6 is a graph of a two-dimensional projection of a response surface that is used in a system for steering a drill bit according to some aspects FIG. 7. is a three-dimensional response surface for another selected drilling parameter used in the system for steering a drill bit according to some aspects.

FIG. 6 is a two-dimensional projection, 600, of a surface like that shown in FIG. 5. In FIG. 6, surface 600 is shown with exclusion areas 602, 603, and 604. These exclusion areas represent nonlinear constraints. For example, exclusion area 602 may be a resonance, otherwise known as places where the drillstring exhibits whirl. Exclusion area 603 may be related to torque & drag issues. Exclusion area 604 may result from a pumping rate restriction. In the example of FIG. 6, a maximum is present at point 606.

Figure 7:
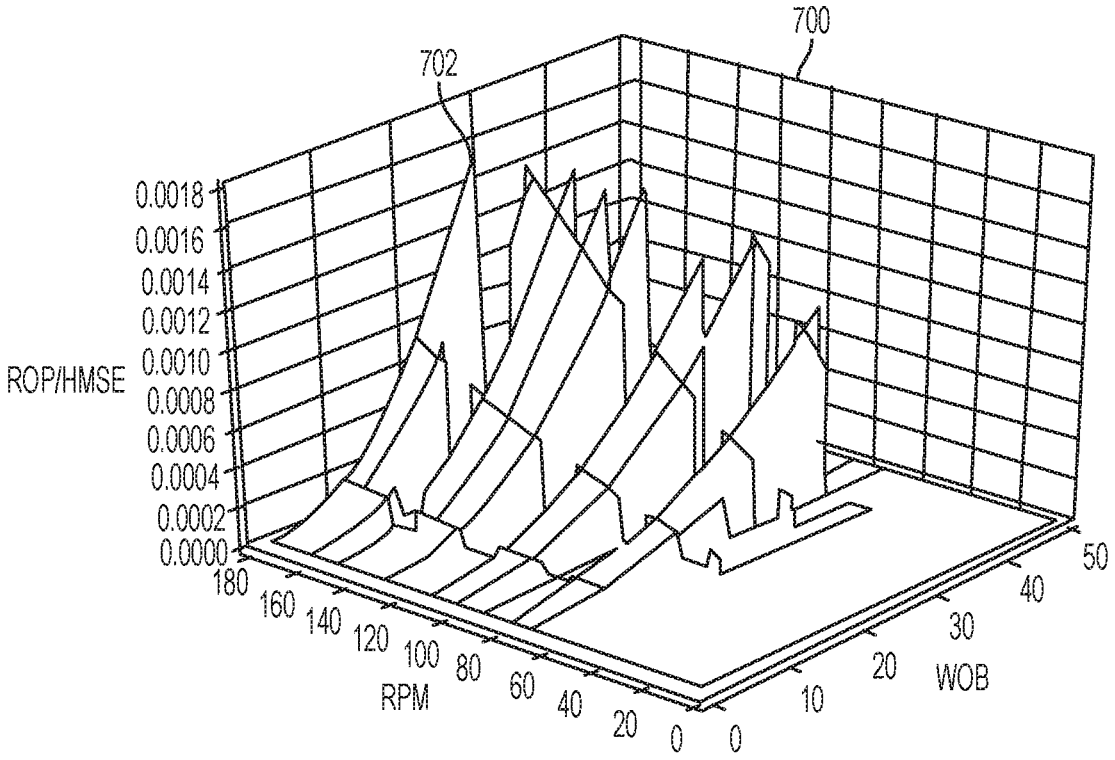

FIG. 7 is an example three-dimensional graph 700 of a response surface generated by the loss function for ROP/HMSE. The horizontal axis in graph 700 for WOB is again in units of pounds per square inch (PSI). The maximum of the surface shown in FIG. 7 is point 702.

In actual use, the example system described herein achieved a maximum ROP of 103.133902 feet per minute, which was a 71% improvement over the maximum rate for the same wellbore that was achieved by trial and error while trying to avoid whirl and debris accumulation. The example system was able to achieve a maximum ratio for ROP/HMSE of 0.0015687874, which was a 91% improvement.

In some aspects, systems, devices, and methods for iterative steering of a drill bit are provided according to one or more of the following examples:

Example #1: A method can include receiving a plurality of iterations of new data associated with a wellbore being formed by a drill bit over a period of time. The method can include, at each iteration of the plurality of iterations over the period of time, applying an engineering model to the new data to produce an objective function defining a selected drilling parameter. The method can include modifying the objective function at each iteration in real time to provide an updated response value for the selected drilling parameter and an updated control value for at least one controllable parameter. The method can include iteratively steering the drill bit to obtain the updated value for the selected drilling parameter by applying the updated control value for the at least one controllable parameter to the drill bit while the wellbore is being formed.

Example #2: The method of Example #1 may feature the engineering model including at least one nonlinear constraint.

Example #3: The method of any of Examples #1-2 may feature a selected drilling parameter including rate of penetration (ROP) and the engineering model comprising a drilling constant and at least one correlation constant determined by regression fit or Bayesian optimization.

Example #4: The method of any of Examples #1-3 may feature an objective function that includes a loss function and may feature minimizing or maximizing the loss function.

Example #5: The method of any of Examples #1-4 may feature a selected drilling parameter including at least one of hydraulic specific mechanical energy (HMSE), or rate of penetration (ROP) over hydraulic specific mechanical energy (ROP/HMSE), and the engineering model comprises a friction coefficient and at least one of an impact force, a torque, a pressure drop, or a bit area.

Example #6: The method of any of Examples #1-5 wherein at least one of the new data or the at least one controllable parameter including at least one of weight-on-bit (WOB), rotations-per-minute (RPM), or flow rate.

Example #7: The method of any of Examples #1-6 wherein the modifying of the objection function may include modifying the objective function by stochastic optimization using Bayesian sampling based on an expected improvement and calculating an actual improvement using a Gaussian model.

Example #8: The method of any of Examples #1-7 may feature the engineering model comprising a drilling constant and at least one correlation constant determined by regression fit or Bayesian optimization.

Example #9: The method of any of Examples #1-8 may feature a nonlinear constraint comprising at least one of whirl, torque and drag, and wellbore fluid pumping rate.

Example #10: A system can include a drilling arrangement and a computing device in communication with the drilling arrangement, wherein the computing device is operable to iteratively steer a drill bit connected to the drilling arrangement. The computing device may be operable to apply an engineering model to data received at an iteration. The computing device may be operable to modify an objective function produced from the engineering model at the iteration to provide a response value for a selected drilling parameter and a control value for at least one controllable parameter in real time. The computing device may be operable to apply the control value for the at least one controllable parameter while the drill bit is forming a wellbore.

Example #11: The system of Example #10 wherein the modifying of the objection function may include modifying the objective function by stochastic optimization using Bayesian sampling.

Example #12: The system of any of Examples #10-11 may feature a selected drilling parameter including rate of penetration (ROP) and the engineering model comprises a drilling constant and at least one correlation constant determined by regression fit or Bayesian optimization.

Example #13: The system of any of Examples #10-12 may feature an objective function that includes a loss function, and may feature minimizing or maximizing the loss function.

Example #14: The system of any of Examples #10-13 may feature a selected drilling parameter including at least one of hydraulic specific mechanical energy (HMSE), or rate of penetration (ROP) over hydraulic specific mechanical energy (ROP/HMSE), and the engineering model comprises a friction coefficient and at least one of an impact force, a torque, a pressure drop, or a bit area.

Example #15: The system of any of Examples #10-14 may feature at least one of the new data or the at least one controllable parameter including at least one of weight-on-bit (WOB), rotations-per-minute (RPM), or flow rate.

Example #16: The system of any of Examples #10-15 may feature a computing device that is operable to modify the objective function by stochastic optimization using Bayesian sampling based on an expected improvement and calculating an actual improvement using a Gaussian model.

Example #17: The system of any of Examples #10-16 may feature an engineering model that incorporates at least one nonlinear constraint.

Example #18: The system of any of Examples #10-17 may feature a nonlinear constraint modeling at least one of whirl, torque and drag, and wellbore fluid pumping rate.

Example #19 can include a non-transitory computer-readable medium that further includes instructions that are executable by a processing device for causing the processing device to repeatedly perform a method. The method can include receiving new data associated with a wellbore being formed by a drill bit over a period of time. The method can include applying an engineering model to the new data to produce an objective function defining a selected drilling parameter. The method can include modifying the objective function to provide an updated response value for the selected drilling parameter and an updated control value for at least one controllable parameter. The method can include steering the drill bit to obtain the updated response value for the selected drilling parameter by applying the updated control value for the at least one controllable parameter to the drill bit while the wellbore is being formed.

Example #20: The non-transitory computer-readable medium of Example #19 may feature instructions that cause the processing device to may feature a selected drilling parameter including rate of penetration (ROP) and the engineering model comprising a drilling constant and at least one correlation constant determined by regression fit or Bayesian optimization.

Example #21: The non-transitory computer-readable medium of any of Examples #19-20 may feature instructions that cause the processing device to use a selected drilling parameter that includes at least one of rate of penetration (ROP), hydraulic specific mechanical energy (HMSE), or rate of penetration over hydraulic specific mechanical energy (ROP/HMSE).

Example #22: The non-transitory computer-readable medium of any of Examples #19-21 may feature instructions that cause the processing device to modify an objective function that includes a loss function.

Example #23: The non-transitory computer-readable medium of any of Examples #19-22 may feature instructions that cause the processing device to modify the objective function for minimizing or maximizing a loss function using stochastic optimization or Bayesian optimization.

Example #24: The non-transitory computer-readable medium of any of Examples #19-23 may feature instructions that cause the processing device to use at least one of the new data or the at least one controllable parameter that includes at least one of weight-on-bit (WOB), rotations-per-minute (RPM), or flow rate.

Example #25: The non-transitory computer-readable medium of any of Examples #19-24 may feature instructions that cause the processing device to modify the objective function by stochastic optimization using Bayesian sampling based on an expected improvement and calculating an actual improvement using a Gaussian model.

Example #26: The non-transitory computer-readable medium of any of Examples #19-25 may feature instructions that cause the processing device to apply an engineering model that incorporate at least one nonlinear constraint.

Example #27: The non-transitory computer-readable medium of any of Examples #19-26 may feature instructions that cause the processing device to use a nonlinear constraint modeling at least one of whirl, torque and drag, and wellbore fluid pumping rate.

Example #28: A non-transitory computer-readable medium featuring instructions that are executable by a processing device for causing the processing device to perform the method according to any of Examples #1-9.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a drilling arrangement; and a computing device in communication with the drilling arrangement, the computing device being operable to iteratively steer a drill bit connected to the drilling arrangement by:

applying an engineering model to data received at each iteration, wherein the engineering model includes an objective function and one or more nonlinear constraints modeling whirl, torque and drag, and pumping rate of wellbore fluid;

modifying the objective function at each iteration;

executing an optimizer comprising the objective function subject to the nonlinear constraints to produce a response value for a selected drilling parameter and a control value for at least one controllable parameter; and applying the control value for the at least one controllable parameter in real timewhile the drill bit is forming a wellbore.

2. The system of claim 1 wherein the selected drilling parameter comprises rate of penetration (ROP) and the engineering model comprises a drilling constant and at least one correlation constant determined by regression fit.

3. The system of claim 1 wherein the selected drilling parameter is at least one of hydraulic specific mechanical energy (HMSE), or rate of penetration (ROP) over hydraulic specific mechanical energy (ROP/HMSE), and the engineering model comprises a friction coefficient and at least one of an impact force, a torque, a pressure drop, or a bit area.

4. The system of claim 1 wherein the objective function comprises a loss function and wherein the modifying comprises maximizing or minimizing.

5. The system of claim 1 wherein at least one of the data or the at least one controllable parameter comprises at least one of weight-on-bit (WOB), rotations-per-minute (RPM), or flow rate.

6. A method comprising:

receiving a plurality of iterations of new data associated with a wellbore being formed by a drill bit over a period of time;

at each iteration of the plurality of iterations over the period of time, applying an engineering model, wherein the engineering model includes an objective function and one or more nonlinear constraints modeling whirl, torque and drag, and pumping rate of wellbore fluid;

modifying the objective function at each iteration;

executing an optimizer comprising the objective function subject to the nonlinear constraints to produce a response value for a selected drilling parameter and a control value for at least one controllable parameter; and iteratively steering the drill bit to obtain an updated response value for the selected drilling parameter by applying the control value for the at least one controllable parameter to the drill bit while the wellbore is being formed.

7. The method of claim 6 wherein the selected drilling parameter comprises rate of penetration (ROP) and the engineering model comprises a drilling constant and at least one correlation constant determined by regression fit or Bayesian optimization.

8. The method of claim 6 wherein the selected drilling parameter is at least one of hydraulic specific mechanical energy (HMSE), or rate of penetration (ROP) over hydraulic specific mechanical energy (ROP/HMSE), and the engineering model comprises a friction coefficient and at least one of an impact force, a torque, a pressure drop, or a bit area.

9. The method of claim 6 wherein the objective function comprises a loss function and the modifying comprises maximizing or minimizing.

10. The method of claim 6 wherein at least one of the new data or the at least one controllable parameter comprises at least one of weight-on-bit (WOB), rotations-per-minute (RPM), or flow rate.

11. The method of claim 6 wherein the modifying of the objective function at each iteration comprises stochastic optimization using Bayesian sampling based on an expected improvement and calculating an actual improvement using a Gaussian model.

12. A non-transitory computer-readable medium that includes instructions that are executable by a processing device for causing the processing device to repeatedly perform a method comprising:

receiving new data associated with a wellbore being formed by a drill bit over a period of time;

applying an engineering model to the new data received at each iteration, wherein the engineering model includes an objective function and one or more nonlinear constraints modeling whirl, torque and drag, and pumping rate of wellbore fluid;

modifying the objective function at each iteration;

executing an optimizer comprising the objective function subject to the nonlinear constraints to produce a response value for a selected drilling parameter and a control value for at least one controllable parameter; and steering the drill bit to obtain the response value for the selected drilling parameter by applying the control value for the at least one controllable parameter to the drill bit while the wellbore is being formed.

13. The computer-readable medium of claim 12 wherein the selected drilling parameter comprises rate of penetration (ROP) and the engineering model comprises a drilling constant and at least one correlation constant determined by regression fit or Bayesian optimization.

14. The computer-readable medium of claim 12 wherein the selected drilling parameter is at least one of hydraulic specific mechanical energy (HMSE), or rate of penetration (ROP) over hydraulic specific mechanical energy (ROP/HMSE), and the engineering model comprises a friction coefficient and at least one of an impact force, a torque, a pressure drop, or a bit area.

15. The computer-readable medium of claim 12 wherein the objective function comprises a loss function and the modifying comprises maximizing or minimizing.

16. The computer-readable medium of claim 12 wherein at least one of the new data or the at least one controllable parameter comprises at least one of weight-on-bit (WOB), rotations-per-minute (RPM), or flow rate.

* * * * *